US007765765B1

(12) United States Patent
Perronne

(10) Patent No.: US 7,765,765 B1
(45) Date of Patent: Aug. 3, 2010

(54) METHOD OF ASSEMBLING POLYSTYRENE FORMS FOR BUILDING FOUNDATIONS

(76) Inventor: Eugene R. Perronne, N2860 Dusty La., Cascade, WI (US) 53011

( * ) Notice: Subject to any disclaimer, the term of this patent is extended or adjusted under 35 U.S.C. 154(b) by 405 days.

(21) Appl. No.: 11/786,727

(22) Filed: Apr. 13, 2007

Related U.S. Application Data

(60) Provisional application No. 60/817,539, filed on Jun. 30, 2006.

(51) Int. Cl.
*E04B 2/84* (2006.01)
*E04G 11/06* (2006.01)
*E04C 5/18* (2006.01)
*E04C 5/20* (2006.01)

(52) U.S. Cl. ..... 52/742.14; 52/747.1; 52/745.1; 52/309.11; 52/309.12; 52/426; 52/562; 52/565; 52/700

(58) Field of Classification Search ..... 52/309.11, 52/309.12, 353, 426, 562, 565, 699, 700, 52/439
See application file for complete search history.

(56) References Cited

U.S. PATENT DOCUMENTS 1,616,977 A * 2/1927 Koivu ..... 52/426
2,029,082 A * 1/1936 Odam ..... 52/275
3,788,020 A * 1/1974 Gregori ..... 52/309.12
4,190,999 A * 3/1980 Hampton ..... 52/687
4,439,967 A 4/1984 Dielenberg
4,516,372 A * 5/1985 Grutsch ..... 52/309.12
4,730,422 A 3/1988 Young
4,866,891 A * 9/1989 Young ..... 52/105
4,884,382 A 12/1989 Horobin
4,888,931 A * 12/1989 Meilleur ..... 52/426
4,894,969 A 1/1990 Horobin
4,924,641 A * 5/1990 Gibbar, Jr. ..... 52/204.1
4,967,528 A * 11/1990 Doran ..... 52/309.12
5,014,480 A 5/1991 Guarriello et al.
5,024,035 A 6/1991 Hanson et al.
5,040,344 A * 8/1991 Durand ..... 52/127.2
5,123,222 A 6/1992 Guarriello et al.
5,140,794 A * 8/1992 Miller ..... 52/309.12
5,323,578 A * 6/1994 Chagnon et al. ..... 52/426
5,566,518 A * 10/1996 Martin et al. ..... 52/426
5,570,552 A * 11/1996 Nehring ..... 52/426
5,704,180 A 1/1998 Boeck (Continued)

*Primary Examiner*—Robert J Canfield
(74) *Attorney, Agent, or Firm*—Robert T. Johnson

(57) ABSTRACT

A method of assembling molded forms of expanded closed cell polystyrene to receive poured concrete for foundations and walls for buildings, including a laid course of forms molded of expanded polystyrene having vertical spaces in the forms and a plastic or metal strip With claws attached to the plastic or metal strip, and the strip is placed in a groove channel in the form and the strip extending into a groove in next abutting form of expanded polystyrene, and the strip width extending into a groove in the next laid course of expanded polystyrene forms and reinforcing bars placed vertically in vertical spaces in the forms of expanded polystyrene, and the reinforcing bars placed vertically in the vertical spaces and held in position by an aperture guide wire having a bias cut on leg end of the aperture guide wire and spanner wires extending across from side to side of the forms of expanded polystyrene, and the spanner wires having bias cut leg ends to stab into the top edges of the forms of expanded polystyrene, and a horizontal reinforcing bar extending into at least one abutting form of expanded polystyrene and, pouring concrete into the laid course.

5 Claims, 5 Drawing Sheets

U.S. PATENT DOCUMENTS 5,809,728 A * 9/1998 Tremelling ..... 52/426
5,839,243 A * 11/1998 Martin ..... 52/439
5,852,907 A * 12/1998 Tobin et al. ..... 52/714
5,890,337 A * 4/1999 Boeshart ..... 52/426
6,321,498 B1 * 11/2001 Trovato ..... 52/426
2004/0200176 A1 * 10/2004 Olsen ..... 52/633

* cited by examiner

METHOD OF ASSEMBLING POLYSTYRENE FORMS FOR BUILDING FOUNDATIONS

CROSS REFERENCE TO RELATED APPLICATION

This application claims the benefit of priority to U.S. Provisional Application No. 60/817,539 filed Jun. 30, 2006, which is hereby incorporated by reference in its entirety.

BACKGROUND OF THE INVENTION

Disclosure is made for assembling molded forms of expanded polystyrene and reinforcements for poured concrete into the apertures of assembled molded forms, and the molded forms stay in place surrounding the poured concrete, to serve as a barrier for sound, heat transfer, and water leakage.

The molded expanded polystyrene forms also serve as a wall finish, or as a back-up for a decorated wall, mounted on furring strips attached to the wall of the expanded polystyrene molded form.

SUMMARY OF THE INVENTION

Molded forms of expanded polystyrene, closed cells, are assembled for foundation walls, and concrete is poured into the molded forms to make foundation walls for buildings and the forms are left in place to provide hot or cold insulation, and the vertical surfaces of the molded forms can be decorated by attaching furring strips to the walls of the molded forms by fasteners extending through the furring strips and into plastic or metal strips mounted in internal horizontal grooves in assembled forms between courses of the matched molded forms of expanded polystyrene. The plastic or metal strips mounted in the horizontal grooves of matching courses are located at the horizontal juncture line between courses of the molded forms of expanded polystyrene. Reinforcing bars (re-bars) are placed horizontally and vertically in the forms, and the vertical re-bars held in position by wire apertures. Spanner wires positioned to span from side to side of the expanded polystyrene forms. Claws with talons are attached to the plastic or metal strips. Pouring of concrete, into the assembly of expanded polystyrene laid forms, covers and imbeds in the concrete all the reinforcement bars, apertures, spanners, claws with talons and other reinforcements.

The expanded polystyrene forms and having closed cells may have a density range of from 1.5 to 2.5 p.c.f, with the preferred density to be about 1.8 p.c.f. (p.c.f.=pounds per cubic foot)

OBJECTS OF THIS INVENTION

Objects of this invention are to disclose a method of assembling molded forms of expanded, closed cell polystyrene to receive poured concrete for foundations for buildings including a strip with claws and the strip placed in groove channel in the form and reinforcing bars both vertical and horizontal and spanner wires connecting sides of the form, and aperture guide wires for vertical reinforcing bars, and legs of the spanner wires and aperture guide wires cut on a bias.

PRIOR BACKGROUND SUBJECT MATTER

The following U.S. patents disclose prior art.

U.S. Pat. No. 4,439,967 for APPARATUS-RELATING TO BUILDING FORMWORK.

U.S. Pat. No. 4,730,422 for INSULATING NON-REMOVABLE-STRUCTURE.

U.S. Pat. No. 4,884,382 for MODULAR BUILDING-BLOCK FORM.

U.S. Pat. No. 4,894,969 for INSULATING BLOCK-CONCRETE WALL STRUCTURES

U.S. Pat. No. 5,014,480 for PLASTIC FORMS FOR POURED CONCRETE

U.S. Pat. No. 5,123,222 for PLASTIC FORMS FOR POURED CONCRETE

U.S. Pat. No. 5,704,180 for INSULATING CONCRETE FORM—FOAM PANELS

The cited U.S. Patents do not collectively make this invention obvious, or individually anticipate this invention.

BRIEF DESCRIPTION OF DRAWINGS

| FIG. NO. | DESCRIPTION |
|---|---|
| 1 | Side elevation view of expanded polystyrene form. |
| 2 | Plan view of expanded polystyrene form |
| 3 | Cross section view molded expanded polystyrene forms aligned for assembly. |
| 4 | Cross section view of assembled expanded polystyrene forms. |
| 5 | Elevation view of plastic or metal strip. |
| 6 | Cross section elevation view of plastic or metal strip and claw. |
| 7 | Side elevation view of assembly of two molded expanded polystyrene forms. |
| 8 | Plan view of assembly of molded form of expanded polystyrene, horizontal reinforcement bars, vertical reinforcement bars, and aperture guides for vertical reinforcement bars, and claws attached to plastic or metal strip, and spanner wires for poured concrete reinforcement |
| 10 | Plan view of wire apertures for vertical reinforcing bars. |
| 11 | Elevation view of wire apertures for vertical reinforcing bars. |
| 12 | Plan view of poured cement in molded form of expanded polystyrene. |
| 13 | Plan view of spanner wires to be inserted across top edges of expanded polystyrene forms. |
| 14 | Elevation view of spanner wires to be inserted across top edges of expanded polystyrene forms. |
| 15 | Plan view of plastic or metal strip and claw attached thereto. |
| 16 | Magnified view of bias cut at end of anchor legs of aperture guide, and spanner wire legs. |

LEGEND DESCRIPTIONS

| LEGEND NO. | DESCRIPTION |
|---|---|
| 1 | Molded, expanded polystyrene form. |
| 2, 2' | Groove channel in molded expanded polystyrene form. |
| 3 | Alignment protrusions fitting in mating spaces. |
| 4 | Plastic or metal strip. |
| 5 | Claw. |
| 6 | Talon. |
| 7 | Web between walls of molded expanded polystyrene forms. |
| 8 | Vertical spaces between webs of |

-continued

| LEGEND NO. | DESCRIPTION |
|---|---|
| | expanded polystyrene forms. |
| 9 | Screw for attachment to plastic or metal strip. |
| 10 | Vertical furring strip mounted on assembled molded expanded polystyrene forms. |
| 11 | Vertical reinforcing bars. |
| 11' | Horizontal reinforcing bar. |
| 12 | Aperture guide wire for vertical reinforcing bar. |
| 13, | Anchor leg for aperture guide |
| 14 | Plan view of spanner wire. |
| 15, 15' | Elevation view of spanner wire legs |
| 16 | Wave trough form in spanner wire. |
| 17 | Concrete poured into the form of expanded polystyrene. (Plan view) |
| 18 | Wave trough shape in wire aperture for vertical reinforcing bars. (See FIG. 11) |
| 19, 19' | Aperture arms. |
| 20 | Bias cut of aperture 12 wire leg 14, and wire legs 15, 15' of spanner wire 14 |

DETAILED DESCRIPTION

Figure 1:
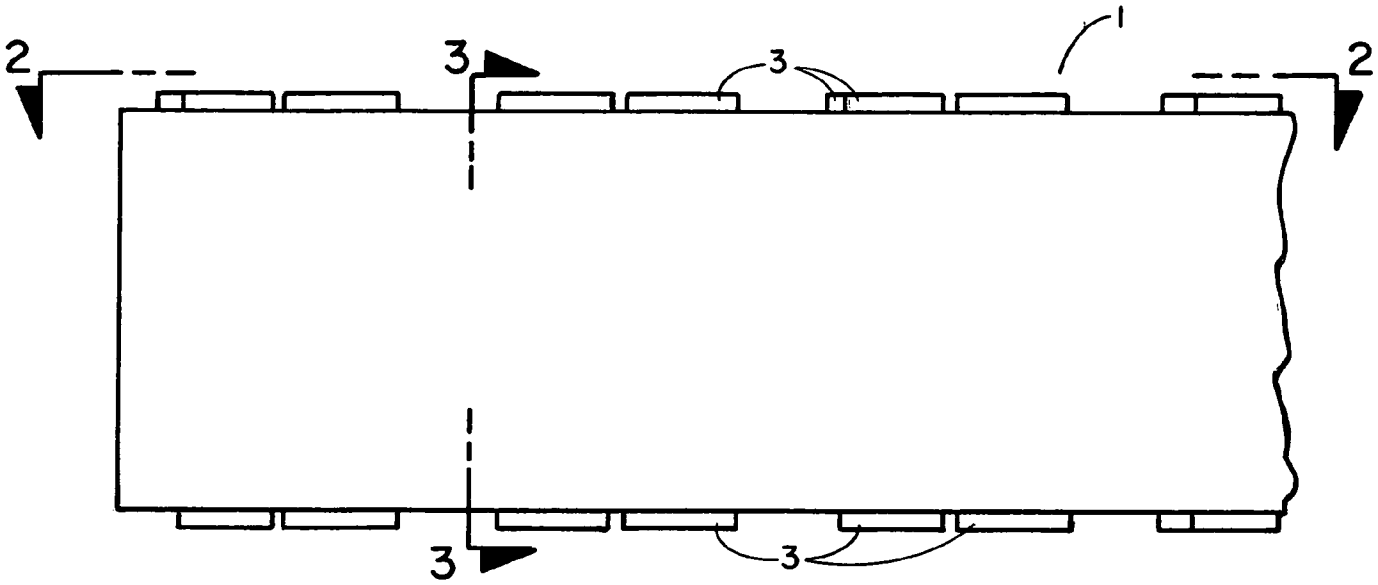
Figure 8:
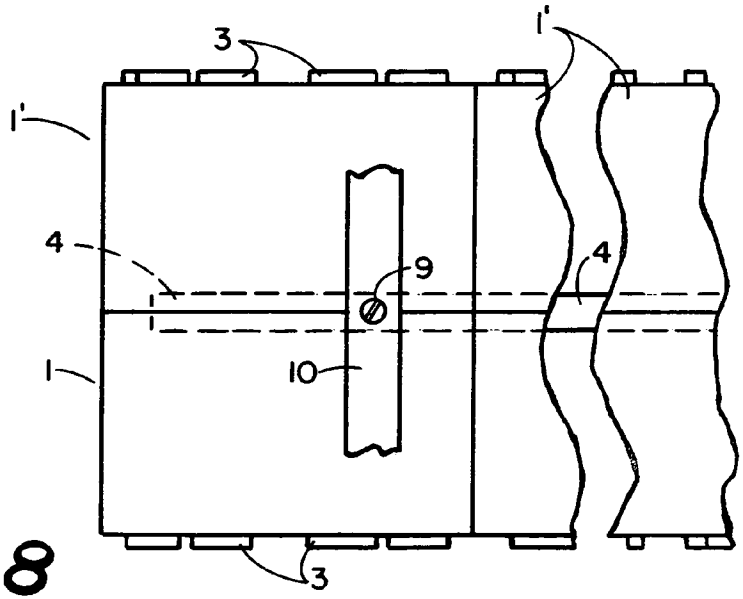

Referring now to the drawings, FIG. 1 is a side elevation view of molded expanded polyethylene form 1, for a poured concrete wall or foundation, and alignment of protrusions 3 to fit into mating spaces in adjoining molded expanded polyethylene form 1' (see FIG. 8)

Figure 2:
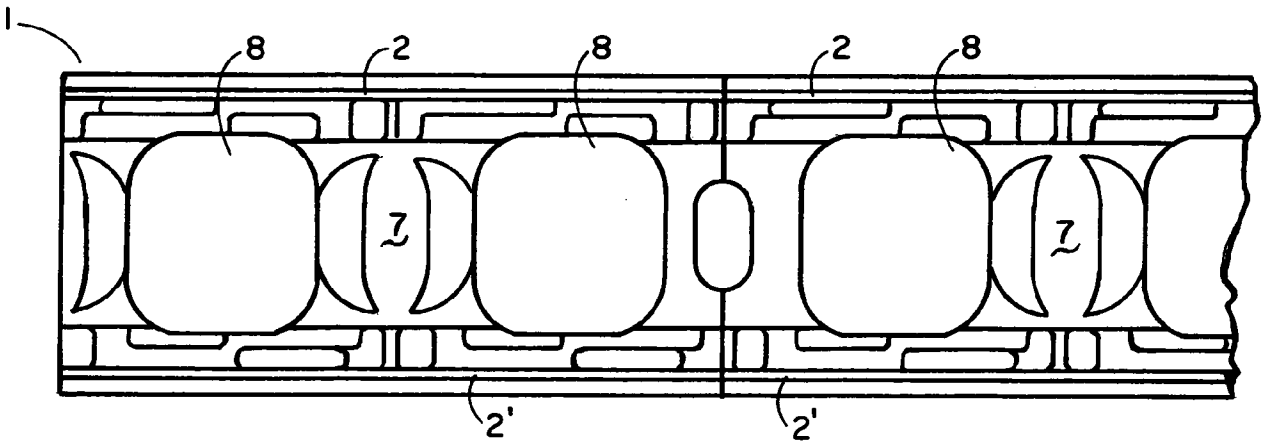

FIG. 2 is a plan view of expanded polystyrene form 1, showing groove channel 2, in the expanded polystyrene form, and webs 7 integrally molded in the form of the same expanded polystyrene material and legends 8 are open apertures for flow of poured concrete 17.

Figure 3:
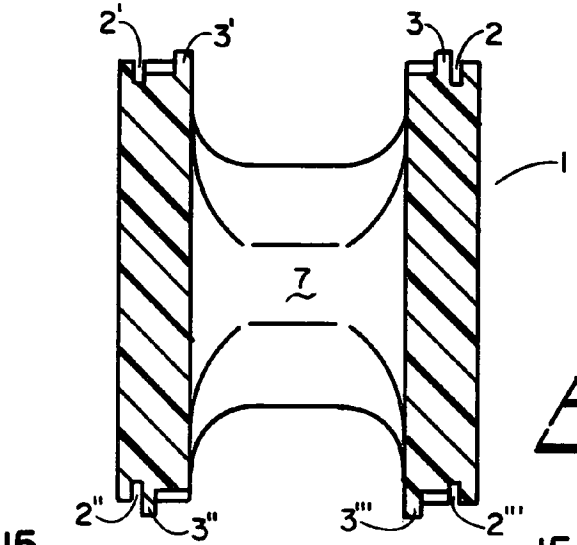

FIG. 3 is a cross section view of FIG. 1 to show the configuration of the web 7 between the walls of the molded expanded polystyrene form and groove channels 2, 2', 2" and 2'" in the top and bottom edges of the molded forms 1, 1'.

Figure 4:
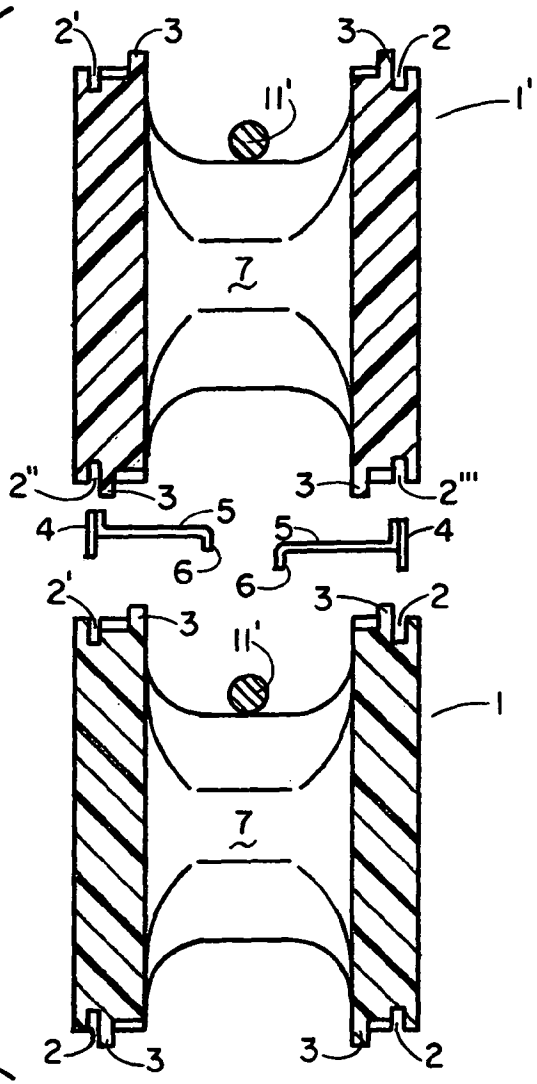

FIG. 4 is a cross section view of molded expanded polystyrene forms 1 aligned for assembly, and includes plastic or metal strips 4, 4', aligned to fit into groove channels 2", 2'" in molded expanded polystyrene form 1' and groove channels 2, 2' in molded form 1 and claw 5, with talon 6 attached to plastic or metal strip 4, extends into aperture or space 8, between webs 7 of molded expanded polystyrene form. The claw 5 and talon 6 will be covered by the poured concrete 17 to thus hold the forms 1, 1' rigidly in position.

Figure 5:
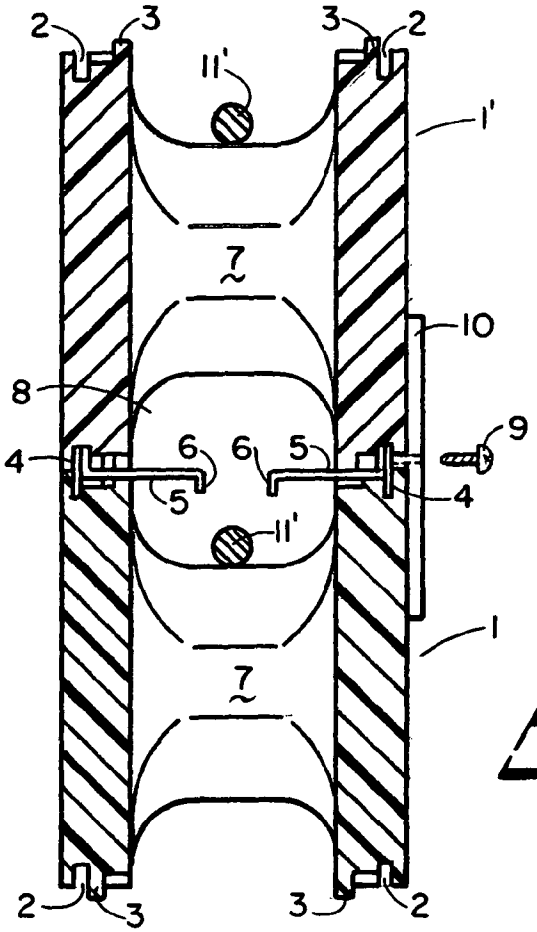

FIG. 5 is a cross section view of assembled expanded polystyrene forms derived from FIG. 4, showing alignment.

Figure 6:
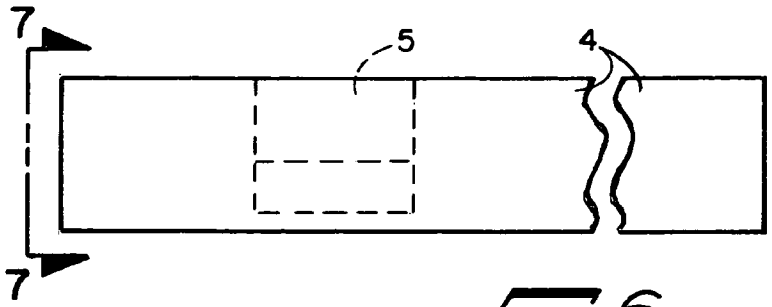
Figure 7:
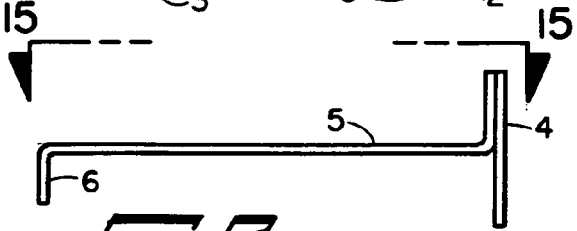

The plastic or metal strip 4 is shown in elevation view in FIG. 6, and can be of variable length as shown by broken lines and claw 5 shown attached to metal strip 4. FIG. 7 is an end view showing the mounting of claw 5, onto the plastic or metal strip 4 and the talon 6 at the outer end of claw 5.

FIG. 8 shows a side elevation view of courses of an assembly of two expanded polystyrene forms 1, 1' mounted one on top of the other and a furring strip 10 mounted in the assembled molded expanded polystyrene forms, and the furring strip 10 attached to the surface of the molded forms 1, 1' using a screw 9 for attachment of the furring strip 10 and the screw 9 extending to and through a the plastic or metal strip 4, shown in phantom in this FIG. 8.

The molded, expanded polystyrene forms 1 assembled for poured concrete 17 may be decorated by applying a wallboard, or paneling directly on the vertical surface of the forms, containing the poured concrete 17, and attaching the wallboard or paneling to the surface by suitable adhesive or by using screws 9 for attachment to the plastic or metal strips 4 embedded in the forms as shown in FIG. 8, or as another alternate furring strips 10, as shown in FIG. 8, may be attached by self tapping screws 9 into the plastic or metal strip 4, to the surface of the expanded polystyrene forms 1, and a decorative surface then applied over the furring strips 10.

Figure 9:
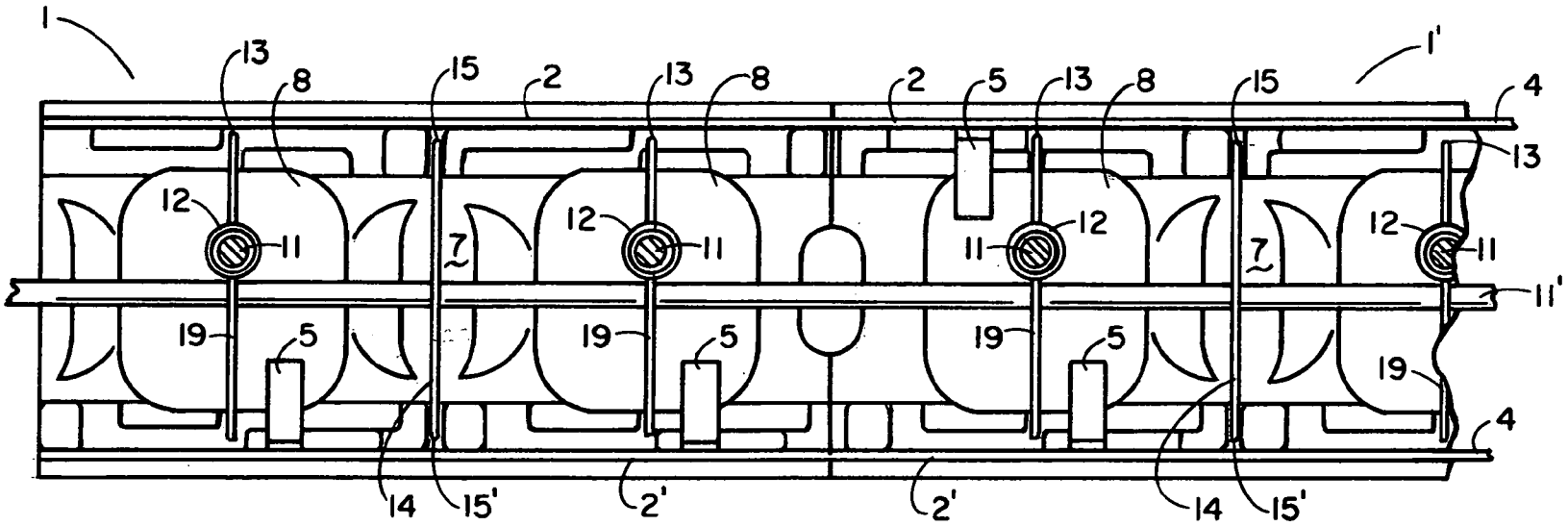
Figure 7:
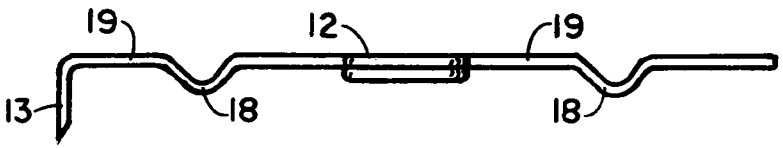

Reinforcing bars 11' can be laid horizontally on the molded expanded polystyrene forms 1, as shown in FIGS. 4, 5, and 9, and further reinforcement can be attained by placing reinforcement bars 11 vertically in the spaces 8 of the laid expanded polystyrene forms 1, (see FIG. 9). Such reinforcement is a matter of choice in specific applications, as needed.

The apparatus of this invention includes plastic or metal strips 4, having claws 5, attached thereto and talons 6, at the outer ends of the claws 5, and the plastic or metal strip 4 having claws 5, is mounted edgewise in groove channels 2, 2', between laid courses of the molded expanded polystyrene forms 1, 1' as shown in FIGS. 5 and 8. As shown in FIG. 7, the claw 5 to be attached to the plastic or metal strip 4 prior to inserting the plastic or metal strip 4 in the groove channels 2, or 2'.

Decorative surface may be attached to smooth wall surface of the assembled molded expanded polystyrene forms 1, 1' etc. by adhesives or screws 9 into the plastic or metal strip 4, inserted into groove channels 2, 2'.

The method of this invention includes mounting of a plastic or metal strip 4 in groove channel 2, of first course of expanded polystyrene form 1, and metal strip 4 having adequate width to extend into groove channel 2' in the next course 1' of expanded polystyrene form laid on the first course 1 of expanded polystyrene form, and a claw 5 attached to the plastic or metal strip 4, and this claw 5 having a talon 6 turned downward on the end of claw 5 and talons 6 attached to the plastic or metal strip 4. On pouring concrete into the expanded polystyrene forms 1, 1' the claw 5 is embedded in the poured concrete 17 to help make a stable assembly.

FIG. 9 is a plan view of abutted molded forms of expanded polystyrene 1, 1' horizontal reinforcement bar 11', vertical reinforcement bars 11, and aperture guides 12 for the vertical reinforcement bars 11, plastic or metal strip 4, and claws 5 attached to the plastic or metal strip 4, and this assembled form is ready for pouring of the cement 17.

Figure 10:
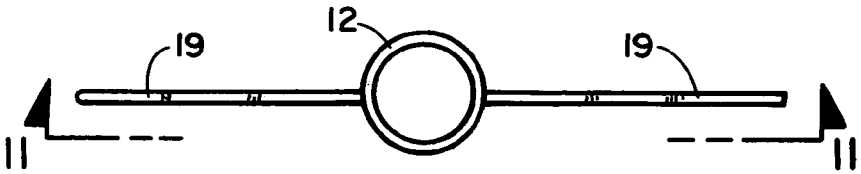
Figure 2:
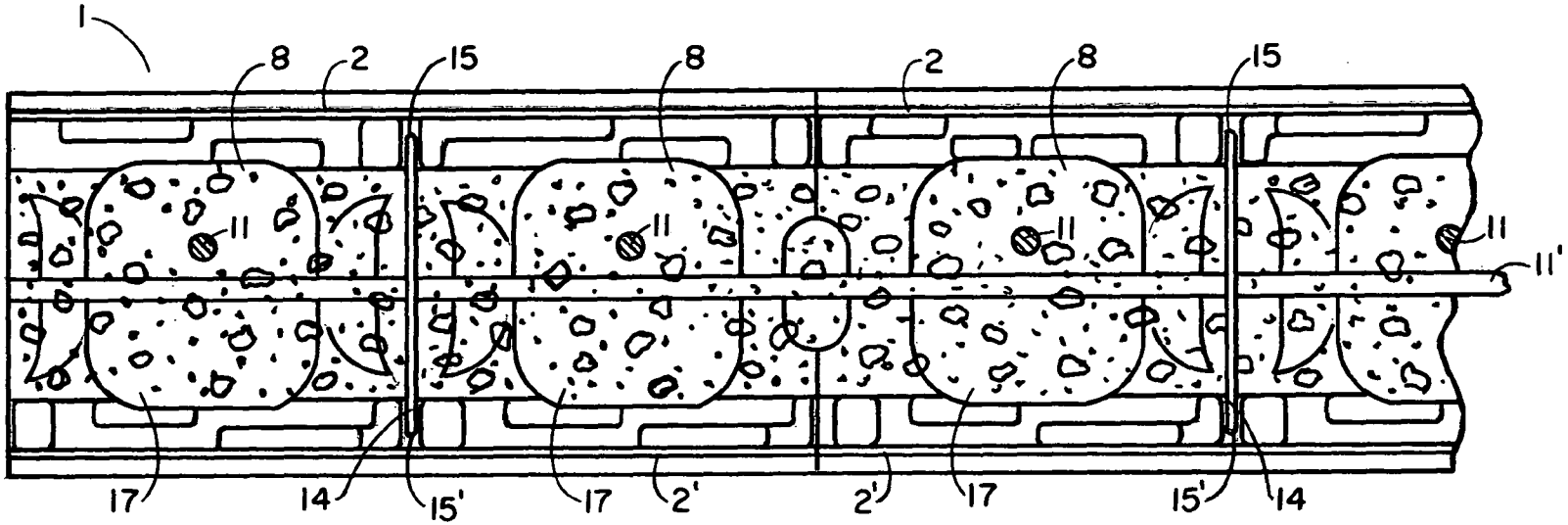
Figure 3:
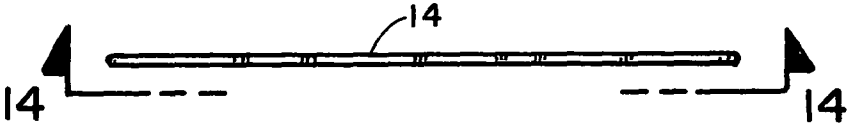
Figure 4:
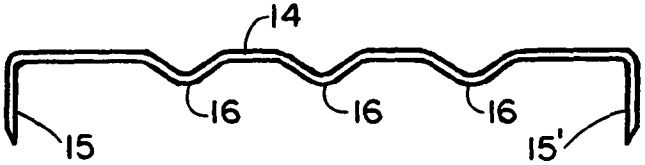
Figure 6:
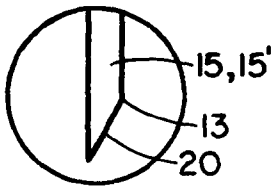

FIG. 10 is a plan view of aperture guide wire 12, and FIG. 11. is an elevation view of aperture guide 12, showing wave troughs 18 on the aperture arms 19, 19' of guide wire of 12 and anchor leg 13, at the end of aperture arms 19.

FIG. 12 is a plan view of FIG. 9, and includes poured cement 17 in the form plan view of FIG. 9. There is also shown in this FIG. 12 spanner wires 14 mounted from side to side of the molded forms of expanded polystyrene forms 1. The spanner wires 14, shown as mounted in FIG. 12 will be covered with poured cement 17 on assembling the next course of forms as described in FIG. 9, above.

FIG. 13 is a plan view of spanner wire 14 and FIG. 14 is an elevation view of the spanner 14 and shows spanner wire legs 15, 15' bent downward and wave trough forms 16 in the spanner wire 14, for better anchoring in the poured concrete 17.

Figure 15:
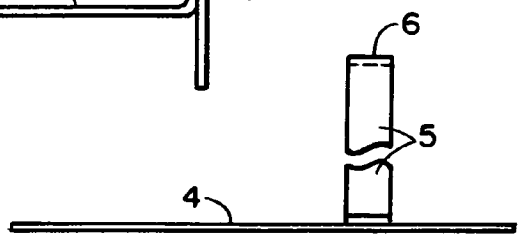

FIG. 15 is a plan view of plastic or metal strip 4 and claw 5 mounted thereon. FIG. 7 is cross section elevation view of plastic or metal strip 4 and claw 5 attached and talon 6 is at the free end of claw 5

FIG. 16 is an enlarged view of the bias cut 20, of the anchor leg 13 for aperture guide wire 12 and spanner wire legs 15, 15'.

Referring now to the plastic or metal strip 4, the plastic strip to be made of polyethylene, polypropylene, or vinyl. The metal strip to be of sheet metal or stainless steel.

The above disclosure is meant to be illustrative and includes an assembly of any number of expanded polystyrene forms in multi courses assembled as described and including the plastic or metal strip 4, claw 5 attached thereto and talon 6 on claw 5 and the plastic or metal strip 4 mounted in groove channels 2, 2', reinforcing bars 11, and 11', aperture guide wires 12 and spanner wires 14 bridging between the walls of expanded polystyrene forms 1.

In all the discussion the "expanded polystyrene forms" are rigid, closed cell, and with smooth vertical surfaces.

Having described my invention, I claim:

1. A method of assembling molded forms of expanded closed cell polystyrene to receive poured concrete for foundations for buildings, wherein the improvement comprises;

(a) laying a course of forms molded of expanded polystyrene having vertical spaces in said forms, (b) providing strips having claws attached thereto, (c) placing said strips in grooved channels of said forms such that said claws extend into said vertical spaces, said strips adapted to extend into a grooved channel of a form in a next abutting course, (d) providing aperture guide wires having bias cut ends stabbed into the forms, (e) placing reinforcing bars vertically in said vertical spaces in said forms, said reinforcing bars placed vertically in said vertical spaces held in said vertical position by said aperture guide wires, (f) providing spanner wires extending across from side to side of said molded forms, said spanner wires having bias cut leg ends to stab into the top edges of said molded forms, (g) placing a horizontal reinforcing bar extending into at least one molded form and, (h) pouring concrete into said laid course.

2. A method of assembling molded forms of expanded polystyrene to receive poured concrete for foundations for buildings, of claim 1, further comprising:

(a) said molded forms of expanded, closed cell, polystyrene having a density of 1.75 to 1.95 pounds per cubic foot.

3. A method of assembling molded forms of expanded polystyrene to receive poured concrete for foundations for buildings, of claim 1, further comprising:

(a) talons attached to said claws.

4. A method of assembling molded forms of expanded polystyrene to receive poured concrete for foundations for buildings of claim 1, further comprising:

(a) wherein said strips are plastic strips selected from the group consisting of polyethylene, polypropylene and vinyl.

5. A method of assembling molded forms of expanded polystyrene to receive poured concrete for foundations for buildings of claim 1, further comprising:

(a) wherein said strips are metal strips of a metal selected from the group consisting of iron and stainless steel.

* * * * *